US009115421B2

(12) United States Patent
Ko et al.

(10) Patent No.: US 9,115,421 B2
(45) Date of Patent: Aug. 25, 2015

(54) METHOD FOR NITRIDING SURFACE OF ALUMINUM OR ALUMINUM ALLOY BY COLD SPRAY METHOD

(75) Inventors: Kyung Hyun Ko, Seoul (KR); Hyuk Jun Lee, Gyeonggi-do (KR)

(73) Assignee: AJOU UNIVERSITY INDUSTRY COOPERATION FOUNDATION, Gyeonggi-Do (KR)

( * ) Notice: Subject to any disclaimer, the term of this patent is extended or adjusted under 35 U.S.C. 154(b) by 392 days.

(21) Appl. No.: 13/641,573

(22) PCT Filed: Apr. 11, 2011

(86) PCT No.: PCT/KR2011/002520

§ 371 (c)(1), (2), (4) Date: Oct. 16, 2012

(87) PCT Pub. No.: WO2011/132784

PCT Pub. Date: Oct. 27, 2011

(65) Prior Publication Data

US 2013/0037174 A1 Feb. 14, 2013

(30) Foreign Application Priority Data

Apr. 19, 2010 (KR) ..... 10-2010-0035700

(51) Int. Cl.

| | |
|---|---|
| ***C23C 22/00*** | (2006.01) |
| ***C23C 8/24*** | (2006.01) |
| ***C23C 8/02*** | (2006.01) |
| ***C23C 24/04*** | (2006.01) |

(52) U.S. Cl.

CPC ... *C23C 8/24* (2013.01); *C23C 8/02* (2013.01); *C23C 24/04* (2013.01)

(58) Field of Classification Search

CPC ..... C23C 8/02; C23C 24/04; C23C 8/24

See application file for complete search history.

(56) References Cited

U.S. PATENT DOCUMENTS

| | | | | |
|---|---|---|---|---|
| 5,302,414 | A | 4/1994 | Alkhimov et al. | 427/192 |
| 2009/0120539 | A1* | 5/2009 | Ko et al. | 148/513 |
| 2014/0295670 | A1* | 10/2014 | Shih et al. | 438/710 |

FOREIGN PATENT DOCUMENTS

| | | | |
|---|---|---|---|
| JP | H10-185440 | 7/1998 | F27B 5/10 |
| JP | 2009-191349 | 8/2009 | C23C 24/04 |
| KR | 10-2005-0081252 | 8/2005 | C23C 4/00 |
| KR | 10-2006-0106865 | 10/2006 | C23C 26/00 |
| KR | 10-2006-0109179 | 10/2006 | C23C 4/04 |
| KR | 10-2006-0114365 | 11/2006 | C23C 4/12 |
| KR | 10-2007-0020808 | 2/2007 | C23C 4/00 |

OTHER PUBLICATIONS

International Search Report (ISR) in PCT/KR2011/002520 dated Dec. 7, 2011.

* cited by examiner

*Primary Examiner* — Veronica F Faison

(74) *Attorney, Agent, or Firm* — Harness, Dickey & Pierce, P.L.C.

(57) ABSTRACT

Provided is a method of nitriding a surface of aluminum or aluminum alloy by cold spraying. That is, a surface of aluminum or aluminum alloy is coated by cold spraying, and then a heat treatment is performed thereon at low temperature for a short time period. Accordingly, the method is suitable for nitriding a surface of Al and Al alloy, which is very difficult to be nitrided, at low production costs. The method includes removing a foreign material from a surface of a mother substrate comprising Al or Al alloy; cold spraying 15 to 50 wt % of a catalyst powder and 50 to 85 wt % of a coating agent powder on the surface of the mother substrate to form a coating layer; and heat treating the coating layer at a temperature of 450 to 630° C. in a nitrogen atmosphere for 2 to 24 hours.

13 Claims, 4 Drawing Sheets

METHOD FOR NITRIDING SURFACE OF ALUMINUM OR ALUMINUM ALLOY BY COLD SPRAY METHOD

CROSS-REFERENCE TO RELATED APPLICATIONS

This application is a national phase application of PCT Application No. PCT/KR2011/002520, filed on Apr. 11, 2011, which claims the benefit and priority to Korean Patent Application No. 10-2010-0035700, filed Apr. 19, 2010. The entire disclosures of the applications identified in this paragraph are incorporated herein by references.

TECHNICAL FIELD

The present invention directs to a method of nitriding a surface of aluminum or aluminum alloy by using a cold spray method, and in particular, to a method of forming a nitride layer on a surface of aluminum or aluminum alloy by introducing an active nitrogen to a site of metal that is emptied by reacting a mother substrate and a coating layer.

BACKGROUND ART

Examples of a method of hardening a metal surface are a chemical surface hardening method in which a metal surface is hardened by changing a chemical composition at the metal surface and a physical surface hardening method in which a metal surface is hardened by performing only a heat treatment without any change in a chemical composition at the metal surface. Examples of a chemical surface hardening method are cementation, nitriding, sulfurising, and boreding, and examples of a physical surface hardening method include annealing. The surface hardening methods are used to improve abrasion-resistance, fatigue strength, corrosion-resistance, and seizure-resistance, and since, recently, a demand for durable, high-performance, and very lightweight machine parts, molds, and tools is increasing, engineers engaged in various fields are paying more attention to surface hardening methods.

Among the surface hardening methods, nitriding is a method in which an active nitrogen (also referred to as generator nitrogen) atom is diffused among metal, thereby performing nitriding. In the case of metal formed of a monometal or an alloy, rigidity, hardness, and abrasion-resistance of the metal are improved by, in general, solid-solution hardening by introducing nitrogen or carbon to the metal. The nitriding treatment may be performed by, in general, ion implantation or plasma deposition. A plasma nitriding is a method in which a vacuum furnace in a rarefied atmosphere of 1 to 10 Torr, hundreds of direct voltage V is applied to $N_2$ gas and $H_2$ gas to cause a glow discharge while a member to be treated acts as negative electrode (−) and a wall of the furnace acts as a positive electrode (+), thereby generating N+ and H+ ions. The N+ and H+ ions collide with a high kinetic energy with a surface of the member to increase the temperature to a treatment temperature and to perform nitriding.

However, the ion implantation nitriding or the plasma deposition nitriding require expensive equipment and high production costs. In addition, it is difficult to form a thick coating layer. Also, there is a need for nitriding aluminum (Al), titanium (Ti), or an alloy thereof without use of vacuum equipment.

DISCLOSURE OF INVENTION

Technical Problem

In response to the problems and the need, the inventors of the present invention repeatedly performed studies and experiments. They found that a surface of Al or Al alloy is nitrided by cold spray coating, which is an environmentally friendly and economically productive coating method. The present invention provides a method of nitriding a surface of Al or Al alloy, which are very difficult to be nitrided, at low production costs. This method includes coating a surface of Al or Al alloy with a coating agent and a catalyst by cold spraying and heat treating the formed coating layer at low temperature for a short time period.

That is, according to the present invention, an active nitrogen is introduced to a site of metal that is emptied by reacting the mother substrate and the coating layer, thereby forming a surface nitride layer of Al or Al alloy, which are impossible to be formed with reference to an equilibrium phase diagram, which is a thermal dynamic equilibrium state. According to the present invention, nitriding is performed at low costs and at relatively low temperature, and a residual stress between the mother substrate and the coating layer is minimized.

Solution to Problem

According to an aspect of the present invention, the method includes removing a foreign material from a surface of a mother substrate including Al or Al alloy; cold spraying 15 to 50 wt % of a catalyst powder and 50 to 85 wt % of a coating agent powder on the surface of the mother substrate to form a coating layer; and heat treating the coating layer at a temperature of 450 to 630° C. in a nitrogen atmosphere for 2 to 24 hours.

Advantageous Effects of Invention

According to the nitriding method according to the present invention, a coating layer including an intermetallic compound is formed at a temperature lower than that in a conventional case. Thus, a mother substrate may be protected from a damage caused by a thermal strain or thermal impact, and cracking either between a mother substrate and a coating layer or in the coating layer may be prevented, and a resistance of the coating layer against cracking caused by fatigue may be improved.

Also, the nitriding method according to the present invention may be used to form a member having a high mechanical strength. Also, since a heat treatment temperature is low, it is less likely that properties of the member are adversely affected when a surface of the member is hardened.

Also, according to the present invention, the relatively low heat treatment temperature may enable formation of a nitride surface modification layer on an Al or Al alloy base, which is impossible with respect to an equilibrium phase diagram that is a thermodynamic equilibrium state. Also, the manufacturing costs are low and the method according to the present invention may also be easily used to nitride a large-size member.

BEST MODE FOR CARRYING OUT THE INVENTION

Figure 1:
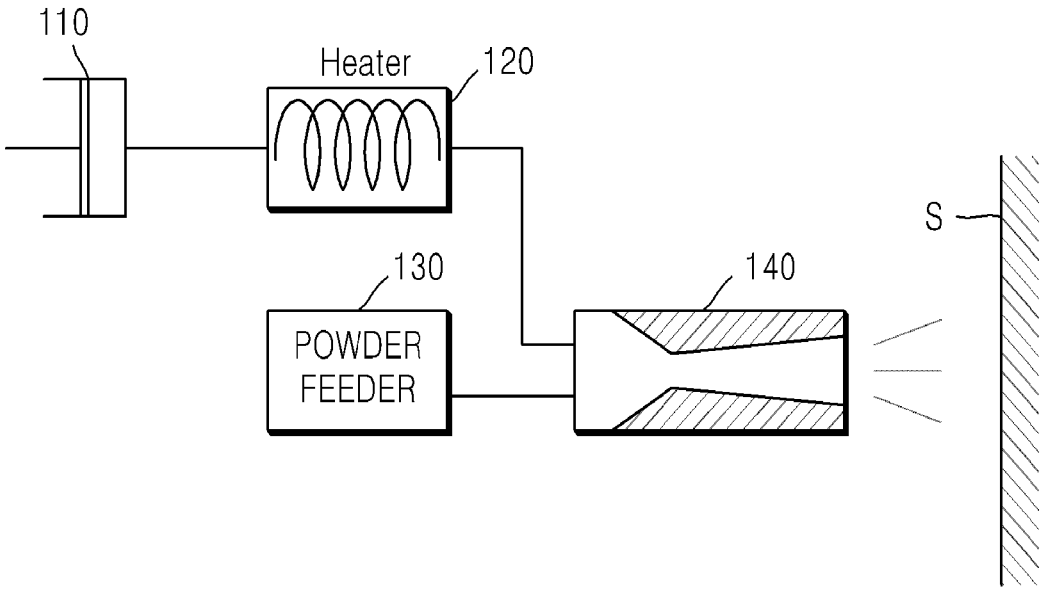
FIG. 1 is a schematic view of a cold spray apparatus used to form a metal base for use in embodiments of the present invention.

One or more embodiments of the present invention will be described in further detail with reference to the following examples. These examples are for illustrative purposes only and are not intended to limit the scope of the one or more embodiments of the present invention.

Hereinafter, the present invention will be described in detail.

The present invention directs to a method of nitriding a surface of Al or Al alloy, and a metal to be nitrided is a mother substrate having a surface including Al or Al alloy base.

The Al refers to a metal that is formed of only Al, and the Al alloy refers to a metal that includes Al and one or more different metals. An alloy including a precipitate or dispersion-strengthening material is also used as the Al alloy, and accordingly, the surface of the mother substrate may be completely or partially formed of Al or Al alloy, which enables formation of an intermetallic compound. The mother substrate may include any of various materials including a metal or an alloy, each of which is coated by a cold spray method, and a composite or a combination having a surface of an Al or Al alloy base that enables formation of an intermetallic compound.

Also, according to the present invention, cold spray coating is performed on the surface of the mother substrate with a coating agent powder and a catalyst powder.

The catalyst powder may be a monometal powder, or a combination of two or more monometal powders to form a multi-component intermetallic compound, such as a three-component or four-component intermetallic compound. In order to facilitate a reaction if necessary, to form a three-component or four-component intermetallic compound, or to secure mechanical properties of a residual layer after an intermetallic compound is formed, as described above, for example, one alloy powder, two or more alloy powders in which two or more alloys are separately prepared as powder, a mixture including a monometal powder and an alloy powder, a mixture including one monometal powder and two or more alloy powders, a mixture including two or more monometal powders and one alloy powder, or a mixture including two or more monometal powders and two or more alloy powders may be used as the catalyst powder. An example of the catalyst powder that is to be combined with Al or Al alloy of the mother substrate may include at least one monometal powder selected from the group consisting of titanium, nickel, chromium, and iron, an alloy powder thereof, or a mixed powder thereof.

The coating agent powder may be aluminum, an alloy thereof, or a mixed powder thereof. That is, since the alloys described above require surface modification, such as abrasion-resistance and hardness, form a stable intermetallic compound, and when heat-treated in a nitrogen atmosphere, are nitrided, use of the combinations described above may be preferred.

An amount of the coating agent powder may be 50 to 85 wt %, and an amount of the catalyst powder may be 15 to 50 wt %. If the amount of the catalyst powder is less than 15 wt %, Al is less diffused, and if the amount of the catalyst powder is greater than 50 wt %, a chemical reaction may less occur due to the small amount of Al in the base. However, if the amount of the catalyst is within the range described above, Al is well diffused and nitrogen is easily introduced.

In general, in a cold spray method, if a particle size is too small, when collision occurs with respect to a coating layer, an impact energy generated is too small since a particle weight is small, although a particle speed is high. Thus, an amount of strain caused by the collision is small and thus, strain energy is less accumulated and a process hardening, such as shot peening, less occurs. In addition, if a particle size is too large, high impact energy may be obtained. However, coating is not well performed and thus, rather than the coating agent powder, only the catalyst powder is coated on the base and thus, ultimately, a chemical reaction of Al is reduced and Al is not well nitrided. Accordingly, as described above, there is an optimal intermediate size range to maximize a modification effect through process hardening and formation of an intermetallic compound. Accordingly, regarding to a cold spray method according to the present invention, it is needed to determine an appropriate particle size in consideration of the impact energy.

When the amounts of the coating agent powder and the catalyst powder are within the ranges described above and impact energy is taken into consideration, an average particle diameter of the catalyst powder may be in a range of 1 to 50 μm, and an average particle diameter of the coating agent powder may be in a range of 20 to 100 μm. If the average particle diameter of the catalyst powder is greater than 50 μm, the particle size is too large and thus an intermetallic compound is slowly formed. On the other hand, if the average particle diameter of the catalyst powder is less than 1 μm, the particle weight is too small and impact energy is small and thus coating is not well performed. Accordingly, the average particle diameter of the catalyst powder catalyst powder is in a range of 1 to 50 μm. In particular, to form an intermetallic compound having an appropriate size to increase a nitrogen introducing efficiency, the average particle diameter of the catalyst powder may be in a range of 1 to 20 μm. If the average particle diameter of the coating agent powder is less than 20 μm, impact energy is small and thus activation may less occur. On the other hand, if the average particle diameter of the coating agent powder is greater than 100 μm, coating is not well performed although the impact energy is high. Accordingly, it is desired that the average particle diameter of the coating agent powder is in a range of 20 to 100 μm.

In the present invention, the coating agent powder and the catalyst powder are sprayed on to the mother substrate at a relatively low temperature compared to a molten spraying temperature or a sintering temperature so as to form a coating layer having collision energy.

The spraying is cold spraying, which is known. For example, cold spraying includes injecting a prepared coating powder into a spraying nozzle for coating, and coating a surface of a mother substrate with the coating powder by accelerating the coating powder in a non-molten state at a speed of 300 to 1,200 m/s by flux of a carrier gas flowing through the spraying nozzle. FIG. 1 is a schematic view of an apparatus for cold spray.

That is, FIG. 1 is a schematic view of a cold spray apparatus 100 for forming a coating layer on a mother substrate S. The cold spray apparatus 100 accelerates a powder for forming a coating layer until the powder has a subsonic or an ultrasonic speed, and provides the powder to the mother substrate S. The cold spray apparatus 100 includes a gas compressor 110, a gas heater 120, a powder feeder 130, and a spraying nozzle 140.

Along with about 5 to 20 kgf/cm$^2$ of compressed gas provided by the gas compressor 110, the powder provided by the powder feeder 130 is sprayed at a speed of about 300 to 1200 m/s through the spraying nozzle 140. In order to generate the subsonic or ultrasonic flux, conventionally, a de Laval-type nozzle like the spraying nozzle 140 illustrated in FIG. 1 is used. Through the convergence and divergence process, an ultrasonic flux is generated.

The gas heater 120 of the cold spray apparatus 100 disposed on a compressed gas supply path is an additional device for heating a compressed gas to increase a kinetic energy of the compressed gas in order to increase a spray rate at the spraying nozzle. However, use of the gas heater 120 is optional. Also, as illustrated in FIG. 1, to smoothly supply powder to the spraying nozzle 140, some of the compressed gas supplied by the gas compressor 110 may be supplied to the powder feeder 130.

The compressed gas used in the cold spray apparatus 100 may be any commercially available gas, for example, helium, nitrogen, argon, or air, and a type of gas for use may be appropriately determined in consideration of a spraying speed at the spraying nozzle 140 and costs.

A detailed description on an operation and structure of the illustrated cold spray apparatus 100 is presented in U.S. Pat. No. 5,302,414 (Anatoly P. Alkimov et al), and will not be presented herein.

The cold spray coating may be performed on the mother substrate at room temperature or low temperature. For example, the cold spray coating may be performed after the mother substrate is heated to a predetermined temperature or higher. By doing so, strain energy generated when the coating powder collides is accumulated and deep collision of the coating powder is induced. That is, even when the coating agent powder is changed into an intermetallic compound in the following heat treatment process, once the coating agent powder is deep stuck in the mother substrate, separation of particles occurring when the mother substrate is used may be prevented. The heating temperature of the mother substrate may be equal to or less than a half of a melting point of the mother substrate. If the heating temperature is as described above, strain energy is accumulated and the coating agent powder is deep stuck.

According to the present invention, after the cold spray coating is performed, heat treatment is performed at a temperature of 450 to 630° C. in a nitrogen atmosphere for 2 to 24 hours.

Figure 2:
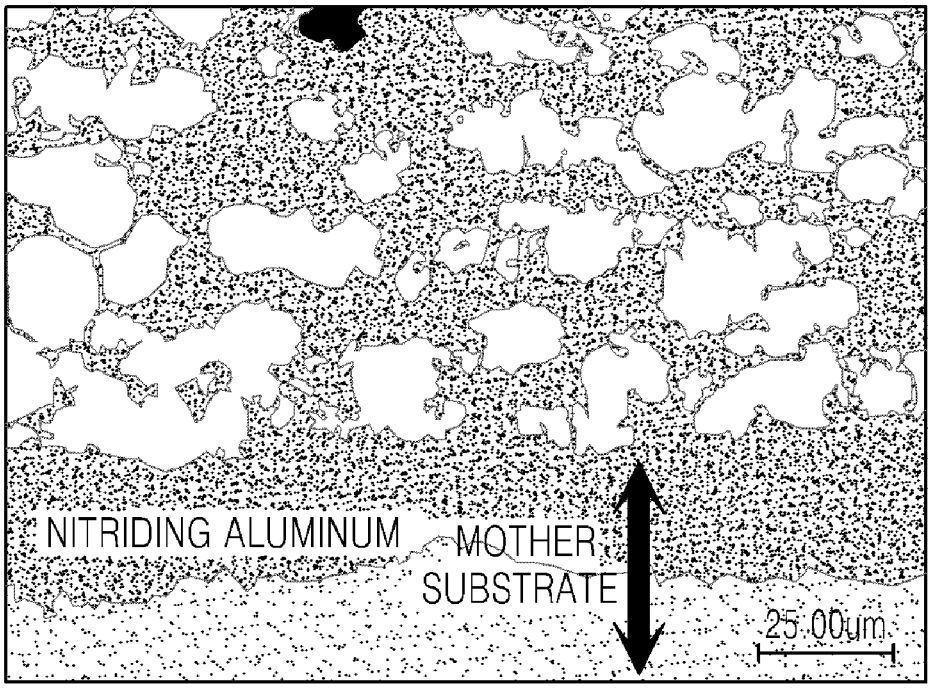
FIG. 2 is an optical image of an interface between an Al mother substrate and a coating layer according to a nitriding method according to the present invention.
Figure 3:
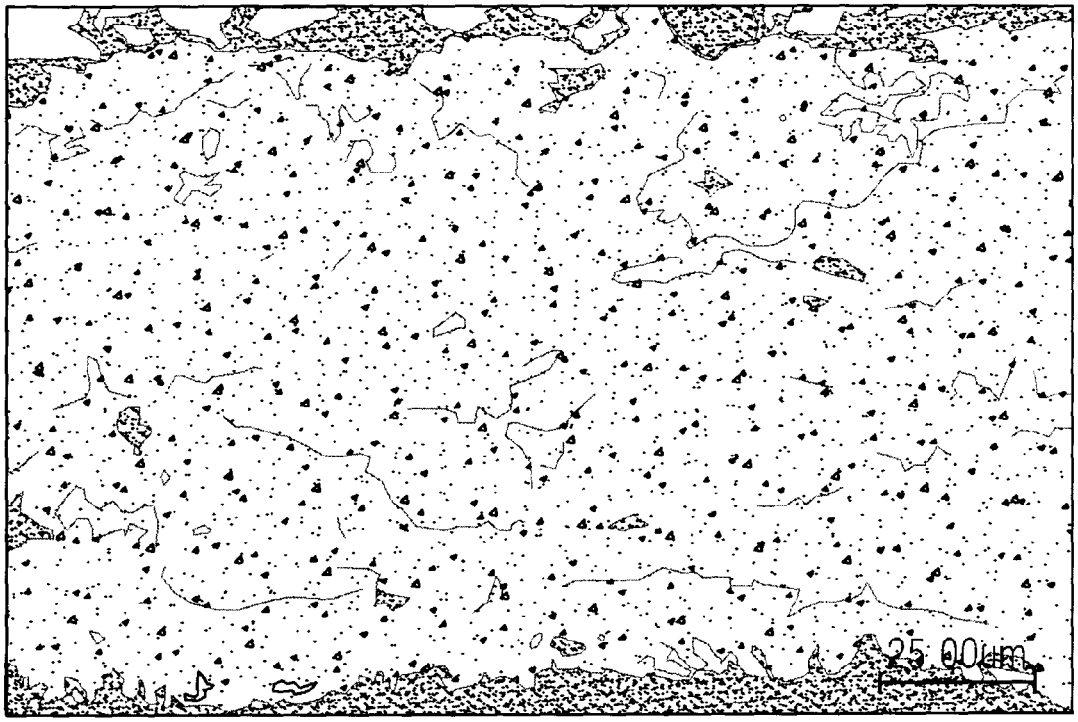
FIG. 3 is an optical image of an interface between an Al mother substrate that is nitrided to a high thickness and a coating layer.

The formed coating layer and the mother substrate are heat treated in a nitrogen atmosphere to form an intermetallic compound and the base surrounding the intermetallic compound is nitrided. The heat treatment may be performed in the nitrogen atmosphere at an appropriate temperature that is determined with reference to an equilibrium phase diagram as illustrated in FIGS. 2 and 3. In particular, according to the present invention, collision particles and the adjacent mother substrate undergo a serious strain with a high strain rate due to the cold spray coating, and have a high vacancy concentration due to the damage, thereby having a high driving force in consideration of an equilibrium phase. Thus, it is possible to form an intermetallic compound at a temperature much lower than a eutectic point or a peritectic point shown in the equilibrium phase diagram, and to nitride a portion adjacent to the inter-metallic compound. Accordingly, the nitrogen atmosphere heat treatment may be performed at a temperature equal to or lower than a eutectic point or a peritectic point of the intermetallic compound in terms of productivity and low manufacturing costs.

As described above, in the atmosphere heat treatment process, the forming of an intermetallic compound and the nitriding of the base are solid-phase reactions and are performed by solid-phase diffusion. Accordingly, if an intermetallic compound is formed in a liquid state as in a casting method or a molten spraying method, the base is also dissolved. Since nitriding is not performed in a molten state, the nitriding may be performed by combination of impact energy of cold spray coating and a solid-phase synthesis.

Meanwhile, it is known that when a conventional powder metallurgy is used, an intermetallic compound is easily formed but a base surrounding the intermetallic compound is not nitrided. This is because an oxide formed at the surface of an aluminum powder interferes a reaction between Al and other metal, and an impact energy, which is a feature of a cold spray method, is not present and thus, nitrogen is not introduced to aluminum or other metal base.

However, according to the present invention, a reaction between Al and other metal may be performed at much lower temperatures. This is because when the sprayed powder collides with the surface of the mother substrate, the surface of the mother substrate is destroyed due to impact energy and Al reacts another metal.

As described above, the nitrogen atmosphere heat treatment is performed at a temperature equal to or lower than an eutectic point (a peritectic temperature), because in the thermodynamic equilibrium state of the temperature, principally, a liquid phase is not present. Thus, an intermetallic compound is formed and introduction of nitrogen based on a solid phase base is performed, thereby enabling nitriding. That is, if the heat treatment temperature is higher than 630° C., a liquid phase is formed and thus, introduction of nitrogen caused by solid-phase diffusion is not performed. Also, if the heat treatment temperature is less than 450° C., diffusion may not occur and thus nitrogen is not introduced. Thus, the heat treatment temperature may be in a range of 450 to 630° C. In this heat treatment temperature range, the heat treatment may be performed for 2 to 24 hours. If the heat treatment time is shorter than 2 hours, a chemical reaction of Al and introduction of nitrogen may not be performed. In addition, if the heat treatment time is longer than 24 hours, too many layers react and thus a reaction layer is separated from the mother substrate.

The nitrogen atmosphere may include nitrogen which is provided at an influx of 0.01 to 11/min, and may further include ammonia.

The nitrogen atmosphere heat treatment may lead to, in addition to formation of the intermetallic compound, a mechanical process for controlling surface roughness, or an improvement in adhesiveness of the coating layer.

After the nitrogen atmosphere heat treatment is performed, the mother substrate may be directly used. Alternatively, before use, a coating powder that does not react to form an intermetallic compound in the coating layer is further removed.

Also, in addition to the processes described above, after the coating layer is formed by cold spray coating with the coating powder, an inert particle that is not related to formation of an intermetallic compound may be further cold sprayed thereon. The spraying of the inert particle may be performed to form a coating layer on the mother substrate. Alternatively, the spraying of the inert particle may be performed such that simply collision occurs and a coating layer is not formed. Also, the method may further include removing the inert gas after the inert gas is sprayed. By doing this, coating powder particles may permeate more uniformly and deeply and thus a surface modification effect may be improved. The inert gas particle may be a ceramic particle or a high hardness ceramic particle. If a high hardness ceramic particle is used and remains on the mother substrate, a surface modification may be performed with an intermetallic compound.

A surface of Al or Al alloy obtained by using the method as described above has a very high hardness. That is, when Al is alloyed by using a conventional method to form a high-hardens Al alloy, the formed Al alloy may have at most 200 Hv. However, a surface of Al or Al alloy that is nitrided according to the present invention has a surface hardness of 350 to 600 Hv.

Example 1

A coating layer was formed on a mother substrate formed of Al by loading a mixed powder including Al powder having an average particle diameter of 77 μm and Ni powder having an average particle diameter of 5 μm in a weight ratio of 6:4 along with flux of a carrier gas at a temperature of 330° C. in 7 atm through a standard laval type nozzle having an aperture of 4×6 mm and a throat gap of 1 mm. A compression gas used was air. The coating layer was heat treated at a temperature of about 600° C. for 8 hours in a nitrogen atmosphere.

The surface of the mother substrate after the heat treatment was performed was observed and it was confirmed that an intermetallic compound among the Al powder, the Ni base, and the mother substrate was formed and nitriding occurred. An optical picture of the result is shown in FIG. 2.

A coating layer was formed in the same manner as described above, except that the heat treatment was performed in a nitrogen atmosphere for 12 hours. Also, a surface of the mother substrate was observed and it was confirmed that an intermetallic compound of Al powder and Ni base was formed. FIG. 3 is an optical image of a thick nitride layer.

As shown in FIGS. 2 and 3, referring to FIG. 2, $Al_3Ni$ intermetallic compound was formed between an Al powder coating layer and a Ni base and is nitrided simultaneously. Also, referring to FIG. 3, it was confirmed that longer heat treatment time leads to thicker nitride layer at the interface. Due to the formation of the intermetallic compound, pores were formed in the surface of the mother substrate, thereby allowing nitrogen to easily permeate into the surface to perform nitriding.

Figure 4:
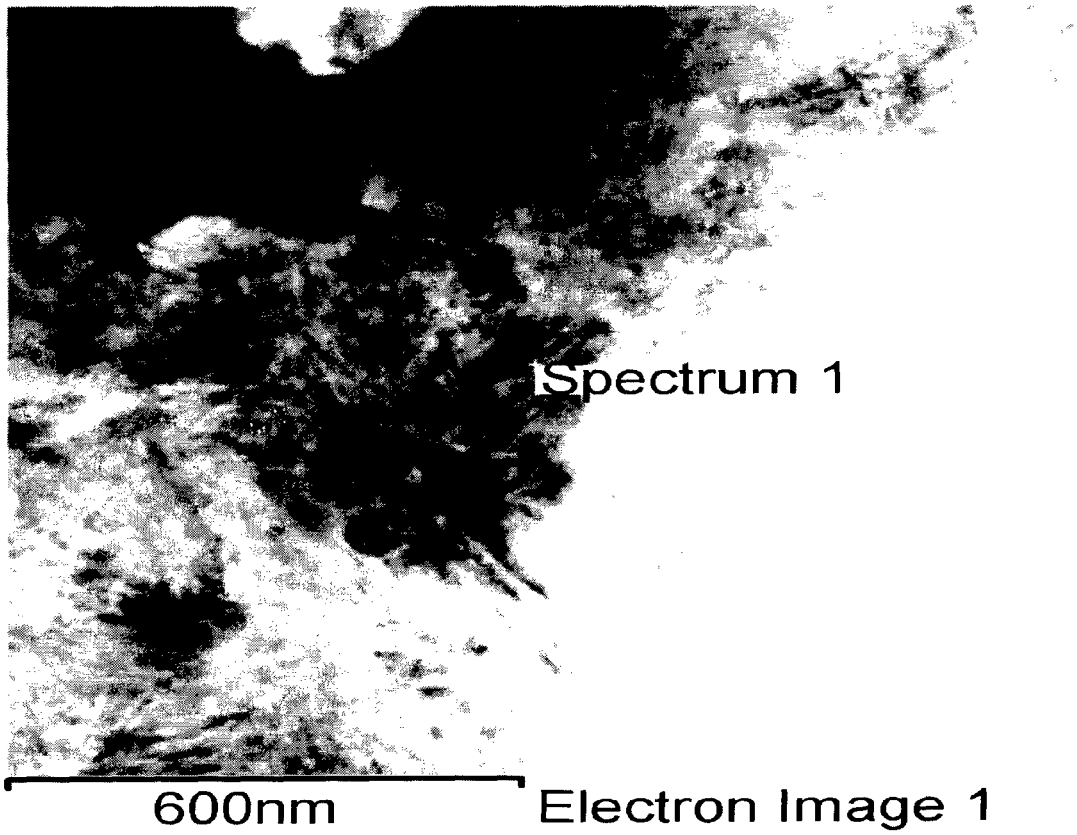
FIGS. 4 and 5 show respectively a TEM image and an EDX image of an interface between a mother substrate formed of Al and a coating layer when a nitriding method according to the present invention is performed.
Figure 5:
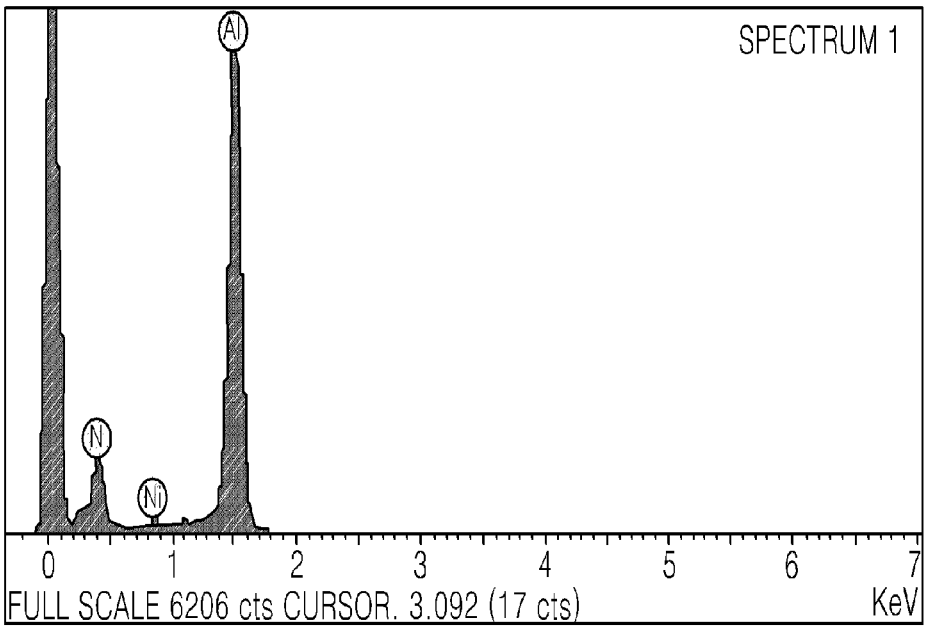

Also, after the heat treatment was performed in the nitrogen atmosphere, TEM and EDX images of Al nitrided by formation of an intermetallic compound were obtained and the results are shown in FIGS. 4 and 5. Referring to FIGS. 4 and 5, it was confirmed that nitrogen was introduced to the Al base.

Figure 6:
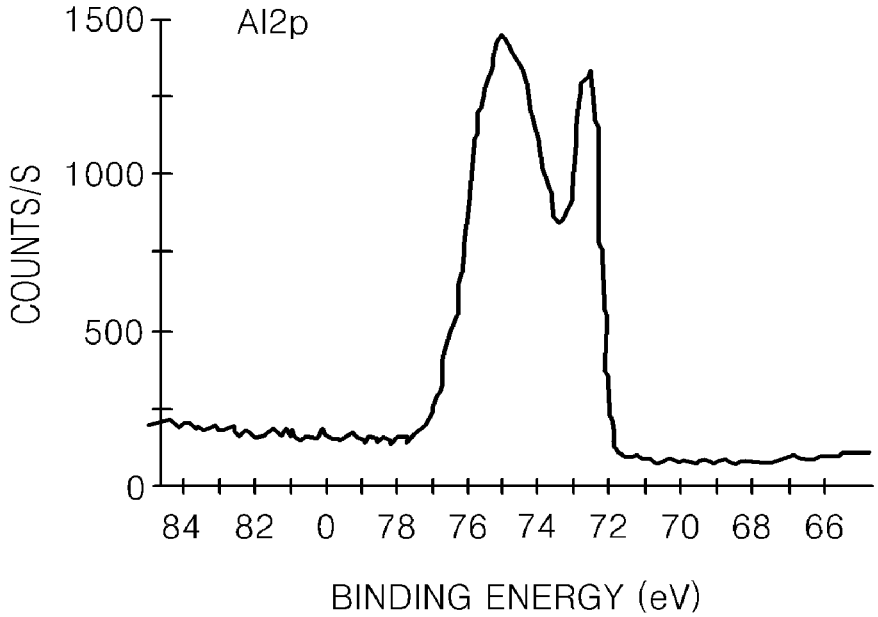
FIGS. 6 and 7 show XPS results of an interface between Al and a coating layer when a nitriding method according to the present invention is performed.
Figure 7:
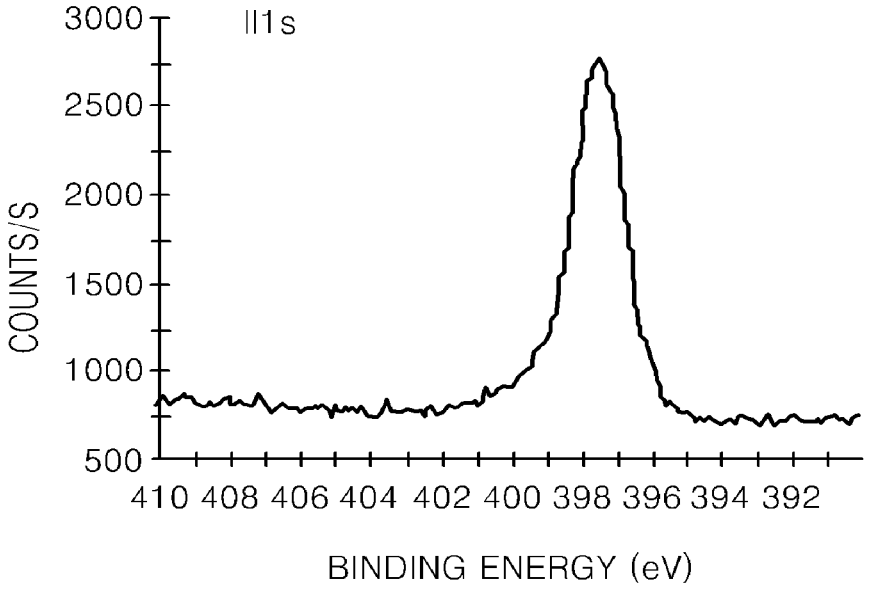

Also, after the heat treatment was performed in the nitrogen atmosphere, XPS of a base surrounding an intermetallic compound formed between the Al base was performed and the results are shown in FIGS. 6 and 7. Referring to FIGS. 6 and 7, it was confirmed that nitrogen was introduced to the Al base.

Example 2

Coating layers were formed on Al mother substrates by loading mixed powders including compositions, average particle diameters, and mixture ratios shown in Table 1 along with a carrier gas flow at a temperature of 330° C. in 7 atm through a standard laval type nozzle having an aperture of 4×6 mm and a throat gap of 1 mm. A compression gas used was air. The coating layers were heat treated in the conditions as shown in Table 1.

A surface hardness of the mother substrates on which the coating layers were formed was measured by using a Vickers hardness tester, and the results are shown in Table 1 below.

TABLE 1

| Mixed weight ratio (coating agent:catalyst) | Heat treatment conditions: Temperature (° C.) | Atmosphere | Time | Hardness (HB) |
|---|---|---|---|---|
| 70:30 | 600 | nitrogen | 8 hours | 400 |
| 80:20 | 600 | nitrogen | 8 hours | 350 |
| 70:30 | 600 | nitrogen | 8 hours | 450 |
| 60:40 | 600 | nitrogen | 8 hours | 470 |
| 30:70 | 600 | nitrogen | 8 hours | 150 |
| 70:30 | 600 | nitrogen | 8 hours | 70 |
| 70:30 | 300 | nitrogen | 8 hours | 65 |
| 70:30 | 600 | nitrogen | 1 hours | 50 |

As shown in Table 1, a hardness of the mother substrates of Invention Examples 1 to 4 is 400 to 470. Such a high hardness may be due to formation of an intermetallic compound and a nitrided surface. On the other hand, in the case of Comparative Example 1,in which a mixed ratio of a coating agent powder to a catalyst powder is outside the condition disclosed in the present invention, since the amount of the coating agent powder was relatively small and the amount of the catalyst was relatively high, a reaction of the coating agent powder was small and thus nitriding occurred less, in the case of Comparative Example 2 in which an average particle diameter of the catalyst powder is too high. The catalyst reacted too slowly with the coating agent, in the case of Comparative Example 3 in which the heat treatment temperature was too low, nitriding occurred less due to a low chemical reaction temperature. In the case of Comparative Example 4, nitriding occurred less due to a very short heat treatment time and a short chemical reaction time.

INDUSTRIAL APPLICABILITY

The present invention can be applied to the field of method of forming a nitride layer on a surface of aluminum or aluminum alloy.

The invention claimed is:

1. A Method of nitriding a surface of aluminum or aluminum alloy, the method comprising:

removing a foreign material from a surface of a mother substrate comprising Al or Al alloy;

cold spraying 15 to 50 wt % of a catalyst powder and 50 to 85 wt % of a coating agent powder on the surface of the mother substrate to form a coating layer; and heat treating the coating layer at a temperature of 450 to 630° C. in a nitrogen atmosphere for 2 to 24 hours, wherein the coating layer formed by cold spraying has a thickness of 300 μm or higher.

2. The method of claim 1, wherein the catalyst powder is a monometal powder comprising one or more selected from the group consisting of Ni, Fe, Ti and Cr; an alloy powder thereof; or a mixed powder thereof.

3. The method of claim 1, wherein an average particle diameter of the catalyst powder is 1 to 50 μm.

4. The method of claim 1, wherein the coating agent powder is Al or Al alloy powder.

5. The method of claim 1, wherein an average particle diameter of the coating agent powder is 20 to 100 μm.

6. The method of claim 1, wherein the cold spraying comprises:

injecting the catalyst powder and the coating agent powder into a spray nozzle; and coating the surface of the mother substrate with the coating agent powder and the catalyst powder by accelerating the catalyst powder and the coating agent powder in a non-molten state to a speed of 300 to 1,200 m/s by flux of a carrier gas flowing in the spray nozzle.

7. The method of claim 1, wherein the cold spraying is performed under a pressure of 3 to 20 $kg/cm^2$.

8. The method of claim 1, wherein in the cold spraying, a gas temperature is room temperature to 700° C.

9. The method of claim 1 wherein the nitrogen atmosphere is formed by feeding gas in an amount of 0.01 to 1 l/min.

10. The method of claim 1, wherein a hardness of the surface of the mother substrate after the heat treatment is performed in the nitrogen atmosphere is 350 to 600 Hv.

11. The method of claim 1, wherein a weight ratio of the catalyst powder and a coating agent power is 20:80, 30:70 or 40:60.

12. The method of claim 6, wherein the coating agent powder is Al or Al alloy powder.

13. The method of claim 6, wherein an average particle diameter of the coating agent powder is 20 to 100 μm.

* * * * *